United States Patent [19]

Di Tella et al.

[11] 4,417,537

[45] Nov. 29, 1983

[54] MOORING BUOY FOR TANKER SHIPS

[75] Inventors: Vincenzo Di Tella, Padua; Dario Falbo, Campalto; Paolo Minardi, Mestre; Roberto Tinebra, Lido di Venezia, all of Italy

[73] Assignee: Tecnomare S.p.A., Venice, Italy

[21] Appl. No.: 402,034

[22] Filed: Jul. 26, 1982

Related U.S. Application Data

[63] Continuation of Ser. No. 173,294, Jul. 29, 1980, abandoned.

[30] Foreign Application Priority Data

Aug. 10, 1979 [IT] Italy ..... 84133 A/79

[51] Int. Cl.[3] ..... B63B 21/00

[52] U.S. Cl. ..... 114/230; 441/4

[58] Field of Search ..... 114/230; 441/3-5; 308/187, 190, 203

[56] References Cited

U.S. PATENT DOCUMENTS

| | | | |
|---|---|---|---|
| 2,950,150 | 8/1960 | Ashworth | 308/187 |
| 3,407,779 | 10/1968 | Satterthwaite et al. | 440/83 |
| 3,440,671 | 4/1969 | Smulders | 441/5 |
| 3,735,435 | 5/1973 | Mikulicic et al. | 441/5 |
| 3,894,567 | 7/1975 | Mott et al. | 441/5 X |
| 4,130,076 | 12/1978 | Van Bilderbeek | 441/5 |

FOREIGN PATENT DOCUMENTS

| | | | |
|---|---|---|---|
| 977272 | 12/1964 | United Kingdom | 441/3 |

*Primary Examiner*—Sherman D. Basinger

*Attorney, Agent, or Firm*—Hedman, Casella, Gibson, Costigan & Hoare

[57] ABSTRACT

A mooring buoy structure for tanker ships is disclosed which comprises an anchoring block secured to the sea bottom, a vertical structure for supporting piping which conveys crude petroleum and like fluids from and to the ship, and a swinging arm installed above the anchoring block and fastened to a structure capable of being rotated about the buoy axis to orient the mooring arm, the latter also being capable of limited vertical rotation in a vertical plane.

3 Claims, 4 Drawing Figures

1
2
3
4
5
6
7
8
9
10
11
12
13
14
15
16
22

MOORING BUOY FOR TANKER SHIPS

CROSS REFERENCE TO RELATED APPLICATION

This is a continuation, of application Ser. No. 173,294 filed July 29, 1980, now abandoned.

BACKGROUND OF THE INVENTION

This invention relates to a mooring buoy for tanker ships, wherein the mooring operation takes place at the anchoring base of the buoy. Mooring buoys for tanker ships known, as "catenary mooring buoys" comprise a floating cylindrical body anchored to the sea bottom by means of a plurality of chains and to which the ship is moored, floating hoses, a rotary joint at the surface and one or more subsea hoses for connection to a subsea conduit. Buoys of the kind referred to above have the following defects:

frequent upkeep and replacement of the subsea flexible hoses, with a pollution hazard due to hose breakage;

hazard of serious damage to the buoy due to possible bumping of the ship, and uneven stress at the points where the chains are anchored to the sea bed, with the ensuing necessity of oversizing the anchoring poles.

Another kind of mooring buoy for tanker ships, called an "articulated buoy" comprises a buoyant body anchored, via a cardan-type joint, to a baseplate placed on the sea bottom, and a rotary joint at the surface with a cardan-type joint at its bottom. A ship is moored relative to the portion of said body which emerges from the sea level, whereas the flow of the fluid to be loaded or discharged to and from the ship, from and to the submarine conduit, respectively, takes place via flexible hoses which are partly floating and partly immersed. This kind of buoy has the following shortcomings:

hoses which are partly immersed and which require frequent upkeep operations, like the buoy of the first-named type;

a bottom cardan-type joint which is both difficult and expensive to upkeep; and the mooring of the ship at the sea level, which involves the pushing body which must have a considerable size.

Another kind of buoy is the one called a "single-chain buoy" and consists of a cylindrical floater which is anchored by a chain to a sea bed baseplate fastened by poles driven into the sea bottom. The hoses, partly floating and partly immersed, connect the ship to a rotary joint placed at the sea bottom.

The mooring cables of the ship are connected to the buoy body.

The defects are the same as those of the articulated buoy, since there is a rotary joint instead of a cardan-type joint at the sea bottom.

SUMMARY OF THE INVENTION

According to the invention, all the drawbacks enumerated above are overcome by a mooring buoy for tanker ships which comprises a baseplate for anchorage to the sea bottom, a buoy body which emerges to the sea surface and is bound to said anchoring baseplate, and at least a mooring cable having either end fastened to a member mounted on said anchoring baseplate and free to be rotated with respect thereto about the buoy axis. Also, the member which fastens the immersed end of every mooring cable can be with an arm the free end of the mooring cable fastened thereto.

BRIEF DESCRIPTION OF THE DRAWINGS

The invention will now be described in detail, in connection with a preferred practical embodiment thereof which is given by way of nonlimiting example only, inasmuch as it is quite possible to introduce a number of changes without departing from the scope of this invention, with reference to the accompanying drawings, wherein:

Referring to FIG. 1 the mooring buoy includes an anchoring block 1 at its bottom of the gravity type or equipped with foundation pillars 2, a spherical joint 3 or an equivalent jointing member having the same degree of freedom, such as, for example, a cardan-type joint, a buoy body formed by a buoyant portion 5, and a stiff leg 4. Alternately the buoy body can have a buoyant portion 5 and a chain, or a fully buoyant body 5. In addition, the buoy includes an assembly 6 for protecting the structure against the bumping of ships, and surface assemblies 7, having a rotatable joint and a rotatable table, floating hoses 8, piping 9, subsea hoses 10, and a subsea conduit 11, for transferring the crude in the loading or the discharging operations, a mooring circular race 12, which can be rotated about the buoy axis, a stiff or rigid mooring arm 13, fastened to the rotatable race 12 but still allowed to rock on vertical planes, and a resilient mooring cable 14, for connecting either end of the mooring arm 13 to the ship. In the inoperative position, the mooring cable 14 can be secured to the rotatable table at the surface.

As shown in FIG. 2 the anchoring block 1 is completed by its foundation of uprights 2, the rotatable race 12, the mooring arm 13, and the supporting member 15. As can be seen in this FIGURE, the rollers 16, guide the race 12.

In FIG. 3 the construction of a roller 16 is illustrated, and shows the lubricant chamber 17 for the bearings 18, the lubricants inlet bore 19 and the lubricant return bore 20. As illustrated, the roller 16 is rotatably mounted on a trunnion 21 through which the bores 19 and 20 extend.

In FIG. 4 the assembly comprises the mooring arm 13, the rotatable race 12, the rollers 16 and the trunnions or pins 21 mounted on an annular support member 22. As indicated by the phantom lines in FIG. 3, the trunnions 21 with the roller 16 and race 12 are removably secured to said member 22, and as shown in FIG. 2, the member 22 is in the form of a ring with a central bore 23 therethrough.

DESCRIPTION OF THE PREFERRED EMBODIMENT

Figures 1, 2:
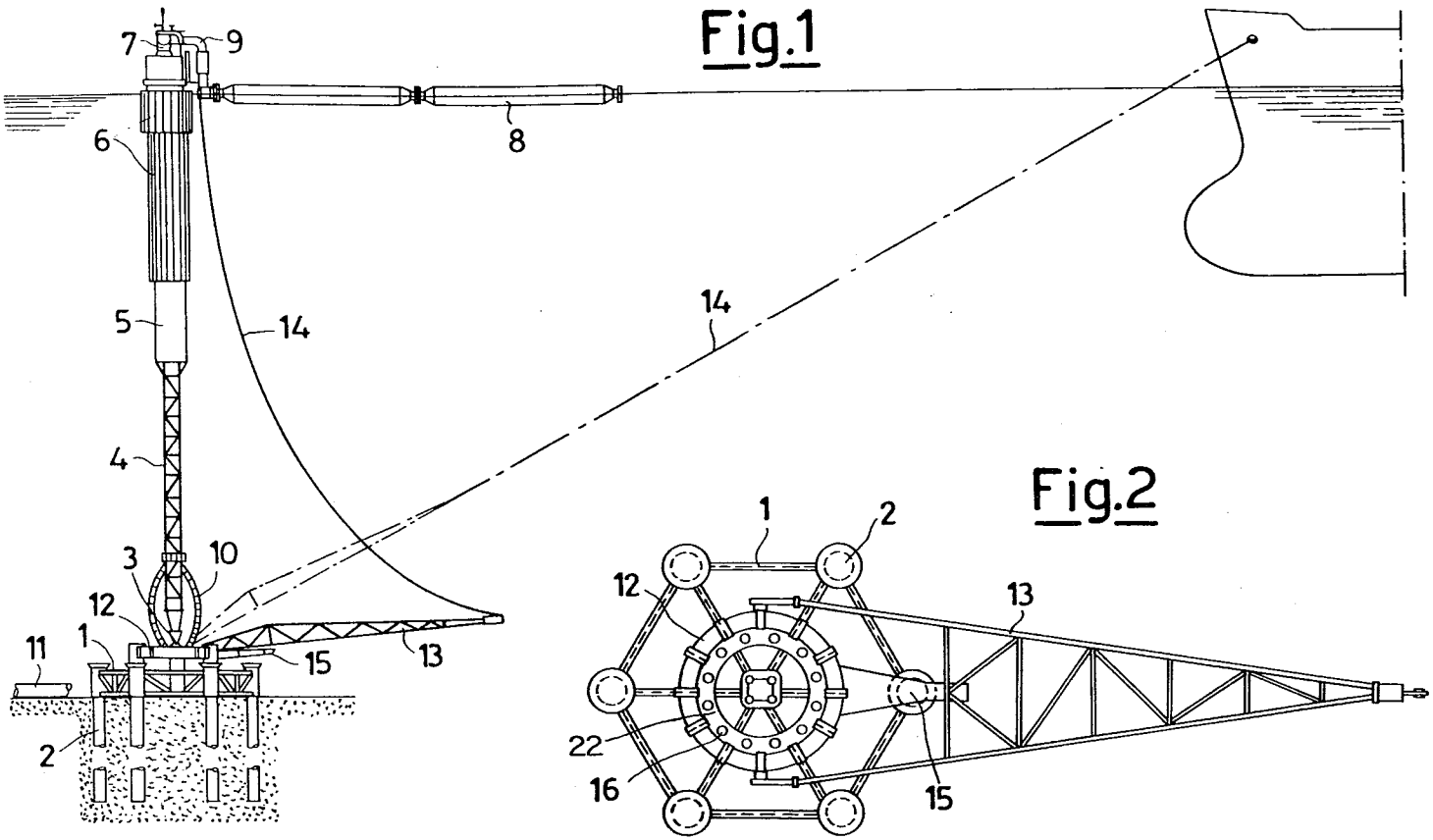
FIG. 1 is an overall view, partly in cross-section, of the device accoding to the invention.
FIG. 2 is a diagrammatical plan view of the swinging arm assembly.

When a ship is not moored, the mooring buoy is in its inoperative position as shown in FIG. 1.

The mooring of the ship takes place directly at the anchoring block 1 by the agency of the stiff mooring arm 13 which can be rotated about the buoy axis by means of the rotatable race 12, so as to become positioned in the orientation in which the ship offers a minimum resistance to sea waves, streams and wind. The mooring cable 14 affords resiliency to the system. The rigid mooring arm 13 is movable on a vertical plane so as to take the correct angular trim as a function of the height of the ship and for being placed in the position of maximum distance from the sea surface when it is inoperative.

The race 12 is guided from its internal periphery, by rollers 16 mounted on the trunnions 21, all mounted on a single dismemberable supporting member 22, so that it becomes possible to lift the entire assembly of the supporting member 22, the rollers 16, the trunnions 21, the race 12 and the mooring arm 13 from the anchoring block 1 to the surface by slipping the entire assembly out without having to overhaul the buoy body 5, because the maximum transversal dimension of the buoy 5 is smaller than the minimum diameter of the supporting member for the rollers 16 (See FIGS. 1 and 2).

Figure 3:
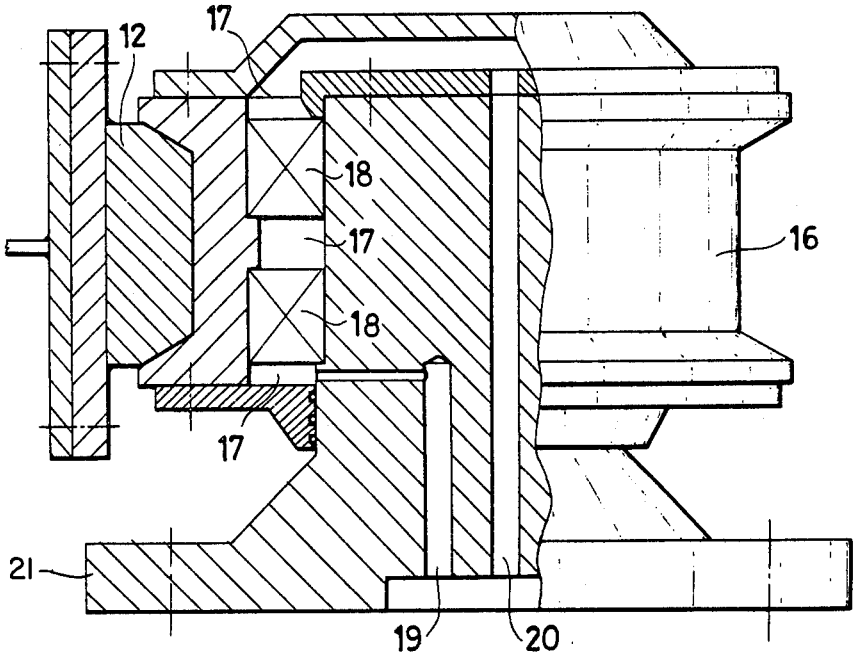
FIG. 3 is a cross-sectional view, partly in elevation, of a roller shown when engaging the circular race.
Figure 4:
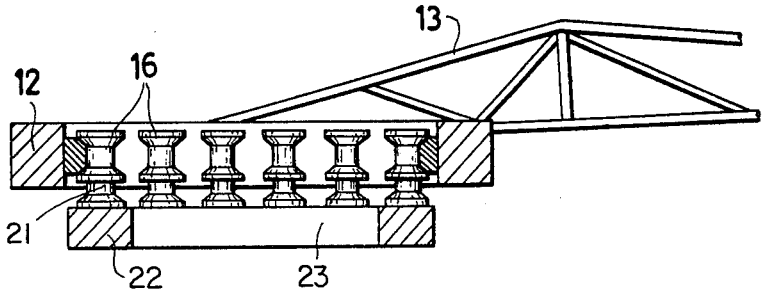
FIG. 4 is a side elevational view, partly in cross-section, of the assembly of the swing arm, the rollers, the race and the bearings.

The casings for the bearings 18 (FIG. 3) on which the rollers 16 of the mooring assembly are rotatable, are filled with a lubricant and are balanced at the pressure exerted thereon by the surrounding environment via a column of a lubricant (pressurized or not) which extends from the bearings to the surface. In order that the bearings 18 may be lubricated from the surface, the casings are serially connected to each other. A forced circulation of the lubricant can be provided through a delivery pipe and a return pipe. This method also allows for detection of possible water seepage into the lubrication line. The lines which connect the bearing casings with the surface can be used for providing the lubricant column which is necessary to balance the environmental pressure. The mooring arm 13 can be rotated from the surface by means of immersed hydraulic means which act upon the race 12 and which are control led by a hydraulic control unit placed at the surface. By so doing, the arm 13 can be oriented along the direction of arrival of the ship so as to simplify the mooring manoeuvers.

The buoy in question exploits the principle of separating the two functions which usually a mooring buoy has, viz. to moor the ship and to transfer the fluid to be conveyed from the ship to the subsea conduit and vice versa.

By so doing, the pull of the ship caused by mooring directly stresses the anchoring block 1 without involving the buoy. It is thus possible to minimize the size of the buoy body since the latter is intended to bear only the surface apparatus, the effects of waves and streams on the buoy and on the floating hoses 8. There also is an anchoring block 1 having a size which is reduced relative to the conventional buoys since the thrust reserve of the buoy is considerably lower, because the buoy is not required to support the moored ship. Also the poles 2 for the anchoring block 1 can be less sturdy and numerous than sometimes necessary due to the instability of the ground.

The buoy 1 is bound to the anchoring block 1 by means of a spherical joint 3 so that it can be shifted from its central position under the thrust of the waves, the streams and in the case of a collision with the ship.

Inasmuch as the buoy body has a comparatively reduced size because it is not a mooring point proper, it offers little resistance to the impact of the ship and is displaced thereby. Thus, the undesirable consequences which could be experienced with other types of buoys in the case of a collision and which could cause damage to the entire assembly are not experienced. In addition, the shape of the buoy allows the apparatus and mechanisms that require periodical upkeep to be on the surface which results in saving on the upkeep costs.

While the invention has been described in connection with certain embodiments thereof, a number of modifications and changes can be introduced therein without departing from the scope of said invention.

We claim:

1. A combination offshore terminal and submerged mooring device for tanker ships, comprising:

a block anchored on the sea bed;

an assembly at the sea bottom removably secured onto said anchoring block, including:

an annular support member releasably connected to said anchoring block, a plurality of stationary pins angularly spaced apart on said annular supporting member and removably secured thereto, a plurality of rollers mounted on and about said pins for rotation thereon, wherein each roller and pin forms a chamber therebetween to be filled with lubricant which balances the pressure with the surrounding environment to inhibit the seepage of water thereinto, and wherein bearing means are mounted in each chamber in contact with said pin and roller to facilitate rotation of said roller relative to said pin and adapted to be lubricated by the lubricant which fills said chamber, and said pin has inlet and outlet bores for conveying lubricant to and from said chamber and for maintaining said chamber filled with lubricant, an annular race for engaging said rollers for rotation therewith as said race is rotated, and a rigid mooring arm connected to said annular race for horizontal rotation therewith and for vertical movement relative thereto to provide the proper vertical angular trim relative to the ship being moored to the device and to permit the lowering of said arm toward the bottom of the sea when said arm is not being used; and an offshore terminal buoyant body universally connected to said anchoring block.

2. The terminal and mooring device of claim 1, wherein said mooring arm has a cable connected to its forward end for mooring the ship to the device.

3. The terminal and mooring device of claim 1, wherein said annular member has a central bore therethrough and the breadth of the buoy body is less than the breadth of the bore so that said annular member with said rollers, pins, race and arm can be removed from the sea bottom and about said body without dismembering thereof.

* * * * *